US005410127A

United States Patent [19]

LaRue et al.

[11] Patent Number: 5,410,127

[45] Date of Patent: Apr. 25, 1995

[54] ELECTRIC BLANKET SYSTEM WITH REDUCED ELECTROMAGNETIC FIELD

[76] Inventors: John D. LaRue; John D. LaRue, Jr., both of 6720 Golf Dr., Dallas, Tex. 75205

[21] Appl. No.: 159,816

[22] Filed: Nov. 30, 1993

[51] Int. Cl.[6] ..... H05B 3/34

[52] U.S. Cl. ..... 219/212; 219/528

[58] Field of Search ..... 219/212, 528, 529, 548, 219/549

[56] References Cited

U.S. PATENT DOCUMENTS

| | | | |
|---|---|---|---|
| 4,908,497 | 3/1990 | Hjortsberg | 219/549 |
| 4,998,006 | 3/1991 | Perlman | 219/212 |
| 5,036,177 | 7/1991 | Pagliarini | 219/212 |
| 5,081,341 | 1/1992 | Rowe | 219/212 |
| 5,151,577 | 9/1992 | Aspden | 219/528 |
| 5,170,043 | 12/1992 | Gunnufson | 219/528 |
| 5,218,185 | 6/1993 | Gross | 219/528 |

FOREIGN PATENT DOCUMENTS

| | | | |
|---|---|---|---|
| 2148633 | 5/1985 | United Kingdom | 219/212 |

*Primary Examiner*—Teresa J. Walberg
*Attorney, Agent, or Firm*—Robert Groover

[57] ABSTRACT

An electric blanket system which runs from an AC power input, and does not use a transformer; but the power supply is rectified and regulated, to reduce the AC component of current by 90% or more (preferably 99% or more). The blanket itself uses a field-cancelling resistor layout, to achieve a further reduction of 95% or more (preferably 99% or more). The combination of these techniques provides a reasonably cheap way to bring the low-frequency magnetic field strength down to acceptable levels.

15 Claims, 3 Drawing Sheets

ELECTRIC BLANKET SYSTEM WITH REDUCED ELECTROMAGNETIC FIELD

BACKGROUND AND SUMMARY OF THE INVENTION

The present invention relates to electric blankets and to controllers for electric blankets.

Electric Blankets

Electric blankets have been used for many years. Commonly, an electric blanket will include two layers of woven material, with resistive elements stitched in between the layers. A connector is brought out to the edge of the blanket, and this connector is plugged into a controller. The controller, which receives power line current, controls the current through the blanket's resistive elements (and thus controls the heat generated in the blanket).

The controller is normally transformerless, and simply modulates the current applied to the resistive elements of the blanket. Normally this controller uses a conventional SCR or triac, like that used in a common dimmer for household lighting circuits.

An electric blanket is inherently very energy efficient. In fact, since the heat is applied directly to the user's skin, it is nearly as efficient an application of heat as is possible. Thus, electric blankets typically draw only about an ampere of current (at 120 V); the peak power of an electric blanket need be only be in the range of the tens of watts.

Electric blankets are not only energy efficient, but provide significantly improved comfort as well. The heat is generated next to the user's body, and other blankets are commonly overlaid on the top of the electric blanket. Moreover, temperature-sensing elements can also be embedded inside the blanket if desired, and the controller can be wired so that it maintains a preset temperature at the user's skin. It is also possible to include multiple zones in the blanket. Thus, extra warmth can be applied to the user's feet, or husband and wife can set different temperatures for the left and right halves of the blanket.

Over their decades of use, electric blankets have been refined to a high degree of safety. However, for all their many advantages, electric blankets have greatly diminished in favor during the 1980s. This is because of one single perceived fault: the current in the resistive elements in the electric blanket generates a magnetic field, at the power line frequency (60 Hertz in the U.S., or 50 Hertz in many other countries). Exposure to this field has come to be regarded, in recent years, as highly undesirable.

Conventional electric blankets have been an extremely cheap consumer appliance. The materials cost of a conventional controller has typically been only a few cents.

Magnetic Fields at Power-Line Frequencies

Some epidemiological evidence has suggested that repeated exposure to magnetic fields at power line frequencies may be dangerous over the long term, even though the field magnitudes are very small. While a plausible causation mechanism for this has not yet been demonstrated (and it is not clear that any plausible mechanism has even been suggested), the epidemiological evidence has been regarded as suggestive enough to cause great concern, and to inspire very active attempts to not only reduce exposure, but also devise experiments for measuring exposure.

In measurements of actual exposure to power line frequencies, it has been consistently found that use of an electric blanket is among the strongest sources of power line fields normally encountered in the home. Indeed, concern about this is so high that one study specifically looked for linkage between electric blanket usage and carcinogenesis.

Some studies have suggested that the biological effects of low-intensity magnetic fields are worst at frequencies from 50 Hz to 400 Hz. Even this much is unclear; but it does appear that, if power-line frequencies are dangerous, then low-order: harmonics of these frequencies will also be dangerous.[1]

[1]Henceforth, all calculations will assume that the power line frequency is 60 Hz, as it is in North America; but of course these calculations can readily be adapted for use in European or other countries where the grid frequency is 50 Hz.

Some studies have reported biological effects from power-line magnetic fields as weak as 50$\mu$G. This is about 1/1000 of the field strength provided by conventional blankets.

Prior Attempts at Reducing the Magnetic Field Exposure of

Electric Blanket Users

The prior art has suggested use of an electric blanket wherein the resistive conductors are routed in adjacent pairs, with the direction of current opposite in the two wires of each adjacent pair. This helps to reduce the electric magnetic field exposure since, in the far field, the magnetic field generated by two such currents will cancel. However, since electric blankets are inherently likely to be used very close to the body of the user, the far-field approximation is an oversimplification,[2] and the magnetic fields will not reliably cancel at the user's skin. Other field-cancellation tricks can also be used, and some novel ones are disclosed in the following disclosure. However, the present invention also provides an innovative approach to field reduction, based on the use of filtered DC current in combination with a field-reduction conductor layout.

[2]It should also be noted that the resistance wire will appear to be an extended linear source at dimensions less than the length of the blanket, and thus the field will diminish only as 1/r over this range of dimensions.

Circuit Techniques for Hum Reduction

As is well known to those skilled in the art of electronics, a full-wave rectifier[3] completely removes the 60 Hz component from the power-line current. However, the rectifier leaves a strong AC component at 120 Hz and harmonics thereof.[4]

[3]This configuration uses four diodes to convert AC input power to an output which is DC-plus-hum. Two diodes source current to one output line from whichever of the AC lines is momentarily at a positive voltage, and the other two diodes sink current to the other output line from whichever of the AC lines is momentarily at a negative voltage.

[4]Using a Fourier series expansion, the full-wave-rectified current waveform can be shown as These 120 Hz and higher components are commonly referred to as "hum." Many conventional power supplies use filtering techniques to remove hum. For example, in home stereo systems it is necessary to reduce the hum power to −60 dB or better, i.e. to one-millionth or less, of the power supply output.[5] This is commonly done using passive filters (including large electrolytic capacitors, and possibly also resistors and/or iron-core inductors), and possibly also active filters (which use switching transistors to rapidly turn the current on and off, to keep near the desired average current or voltage level).

[5]Thus hum voltage must be reduced by 1000:1 or more.

Rectification easily provides about a 50% reduction in AC current levels. However, further reduction of the magnitude of the AC current[6] components is more difficult. At such low frequencies, passive reactive components must be relatively large (and expensive)

$$y = 1 + \frac{2\cos 2\theta}{3} - \frac{2\cos 4\theta}{15} + \frac{2\cos 6\theta}{35} - \ldots$$
$$= \sum_k (-1)^{k+1} \frac{2\cos(2k\theta)}{4k^2 - 1}.$$

times a scaling factor. (See RADIOTRON DESIGNERS'HANDBOOK 302 (4th ed. 1950), which is hereby incorporated by reference.) Thus the resulting proportional current levels (unsigned) are 0 Hz (DC) ("0th-order" harmonic): 51.2%; 120 Hz: 34.1%; 240 Hz: 6.8%; 360 Hz: 2.9%; 480 Hz: 1.6%; 600 Hz: 1.0%; 720 Hz: 0.72%; 840 Hz: 0.53%; 960 Hz: 0.40%; 1080 Hz: 0.32%; 1200 Hz: 0.26%; etc.

[6]Note that, in configuring and evaluating alternative embodiments of the present invention, it is the AC current which must be reduced, rather than the AC power (since the magnetic field is generated by fluctuations in current). to have much effect. For example,, consider the case of an electric blanket rated for 120 W at full power. In this case, the RMS current will be 1A, so the resistance of the heating elements is 120Ω. The magnitude of the 120 Hz current component is about 500 mA. To cancel this current component, the amount of charge which would have to be supplied during a half-cycle of is roughly 500 mA·40 msec=0.02 Coulomb.[7] To supply this much current with a voltage swing of only 1 volt would take a 20,000 μF capacitor (or bank of capacitors) with a continuous-duty current rating of at least 500 mA and a peak voltage rating of at least 100 V. As of 1991, such a capacitor would cost around $25, and would itself be builder than a normal electric blanket controller.

[7]Hum removal in a small-signal line is much easier. For example, if a 1000 μF electrolytic capacitor (which is a fairly large size) is connected across a 120Ω resistive load, the 120 Hz hum voltage will be attenuated by a factor of about 200. However, this is true only if charge transferred during one half-cycle of the hum current is small in relation to the size of the capacitor times the hum voltage.

Thus, a purely capacitive (RC) filter is not good enough. If a purely passive filter is to be used, it must include a series inductor (choke). For example, an 11 mH iron-core choke, rated at 1 A, costs about $7. At 120 Hz, such a choke: has a reactance of about 8Ω. In a sample embodiment, if such a choke is combined with an 18,000 μF shunt capacitor, the attenuation of 120 Hz current (i.e. the filter factor) would be about 111:1. This is adequate attenuation, but the cost is high, and the weight of the control module will also be high.

SUMMARY OF THE INVENTION

The present invention provide an improved electric blanket and blanket controller, which greatly reduces exposure of a user to magnetic fields.

The electric blanket system of the presently preferred embodiment runs from an AC power input, and does not use a transformer; but the power supply is rectified and regulated, to reduce the AC component of current by 90% or more.

In the presently preferred embodiment, a small capacitor is provided after the full-wave rectifier. This capacitor provides some minimal smoothing of the current output of the full-wave rectifier. A series switching regulator circuit is :provided downstream of this filter stage, and regulates the voltage applied to the resistive element in the blanket.

In the presently preferred embodiment, the electric blanket uses not only current regulation and hum reduction, but also uses a field-cancelling conductor layout. Either of these techniques alone can achieve some field strength reduction, but cannot provide as much as is desired, within a reasonable cost target. This permits a field strength reduction of better than 100:1.

A variety of conductor structures can be used for field reduction. First, by using stacked ribbon-type conductors, the magnetic field strength can be reduced, even in the near-field region at the user's skin. Even if ribbon-conductors are not available, some further field reduction can be achieved by bundling wires together in a "quadrupole"structure. For example, if each strip of wires uses four wires together, the wires will be connected so that the current senses are plus, minus, minus, plus. If the wires can be bundled in a diamond configuration, with the two positive-current wires at opposite corners of the diamond, and the two negative-sense currents also at opposite corners of the diamond, this can be even more advantageous (because the opposed dipoles are now spaced closer together, from any angle of view). Similarly, other arrangements can be made to a) space the dipoles closer together and b) align the axis of separation of the dipoles more in the vertical direction.

The best field reduction can be achieved by a coaxial cable (or by an approximation thereto). However, even with coaxial resistance wires, bends in the wires are still likely to produce points of current imbalance, and hence localized electromagnetic radiation. A further advantage of the disclosed inventions is that optimization of the controller can avoid the need for the maximal field suppression achieved by a coaxial structure.

Preferably the regulated DC voltage is set considerably below the nominal line voltage. This reduces the necessary size of the capacitors. For instance, at a nominal line voltage of 120 volts AC, the peak-to-peak voltage on the line will be about 170 volts. In the full-wave-rectified waveform, the voltage will be more than one-half of the peak voltage at all times except when the voltage waveform is within 30 degrees[8] of a zero-crossing. Thus, in the full wave rectified waveform, current must be supplied from the capacitor for 60 degrees of phase twice in every 360 degree cycle. At 60 Hertz, this translates

[8]Phase angles in this discussion are referred to the power line frequency, i.e. 60 Hz or 50 Hz, and not to the hum frequency. to a little less than 3 milliseconds of discharge time.[9] To supply one amp of current, from an initially charged voltage of about 160 volts, without dropping below the target voltage of 85 volts, for 3 milliseconds, requires a capacitor of about 40 microfarads.

[9]The capacitor can be charged up during the remaining 120 degrees of each half cycle. At 60 hertz, this translates to about five and a half milliseconds.

Note that an operating voltage of 85 volts would deliver only one-half of the power, from an electric blanket of the same resistance, as an AC voltage of 120 volts would. Thus, most preferably, the new control method is used with an electric blanket having a lower series resistance (for the same power-line voltage) than a prior-art blanket would.

Note also that if the operating voltage is lowered further, even better filtering can be achieved, or the cost of the capacitors can be reduced even further.

Note that the blanket system of the presently preferred embodiment uses no inductors or transformers. This helps provide reduced cost and light weight.

In the early days of the electric power industry, when DC power was still a candidate for wide-spread use, many household appliances were manufactured with a DC-compatible or an AC-incompatible electrical configuration. It is not impossible that in these days DC-powered electric blankets may have been manufactured (although no such technology is known to the present inventors). However, the present invention takes a different approach: the presently preferred embodiment of the present invention provides an electric blanket which is powered from an AC power line, and which rectifies and filters the power line current to provide a DC current which actually drives the resistance elements in the blanket. A series regulator circuit is optionally used to reduce the hum component in the current through the blanket.

BRIEF DESCRIPTION OF THE DRAWING

The present invention will be described with reference to the accompanying drawings, which show important sample embodiments of the invention and which are incorporated in the specification hereof by reference, wherein.

[10] For simplicity of discussion, voltage waveforms are shown; but of course each of these voltage waveforms, if connected to a small purely resistive load, will provide a corresponding current waveform.

Figure 2A:
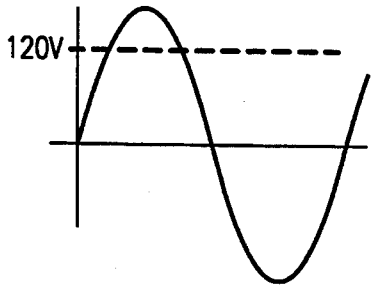
FIG. 2A shows the voltage waveform[10] of unmodified 60 Hz power-line voltage.
Figure 2B:
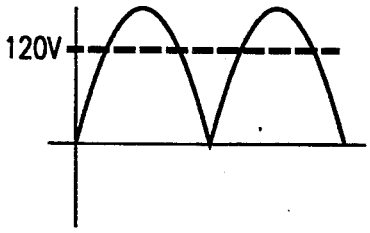

FIG. 2B shows the voltage waveform of a full-wave-rectified voltage, containing a strong hum component at 120 Hz and higher harmonics, derived by passing the waveform of FIG. 2A through a full-wave-rectifier.

Figure 2C:
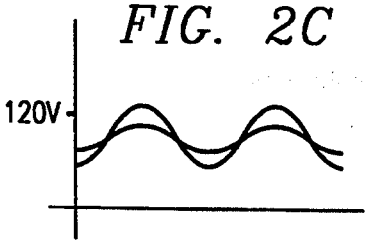

FIG. 2C shows further voltage waveforms, each derived by passively filtering a full-wave-rectified waveform like that of FIG. 2B. The different overlaid waveforms seen in this Figure show the dependence of the filtered current on the load impedance in relation to the size of the filter capacitor.

FIGS. 3A through 3D show cross-sections of various wiring configurations which can be used to achieve partial cancellation of magnetic fields.

Figure 4:
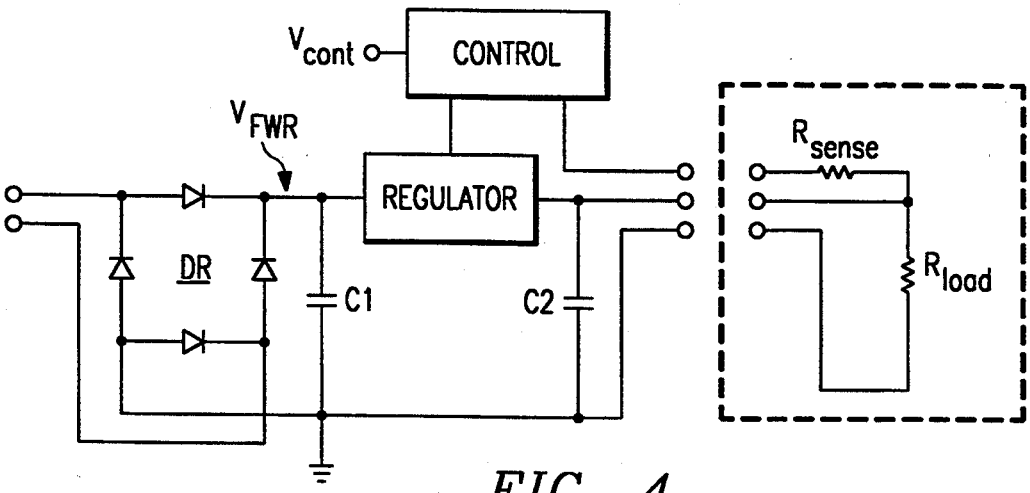

FIG. 4 is an electrical block diagram of the controller and blanket of the presently preferred embodiment.

Figure 5:
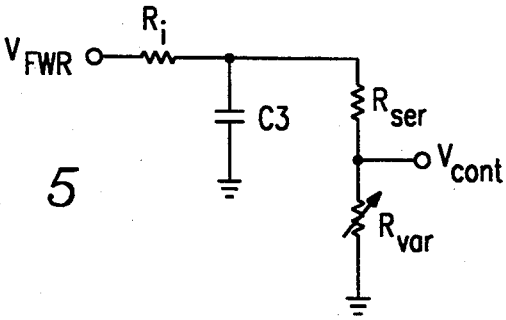

FIG. 5 shows how a control voltage $V_{cont}$ is derived, in the presently preferred embodiment.

DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Power Supply and Control

FIG. 4 is a block diagram of the controller and blanket of the presently preferred embodiment. A diode ring DR provides a full-wave-rectified output $V_{FWR}$, which is smoothed slightly by capacitor C1. The full-wave-rectified output $V_{FWR}$ will have a peak voltage in excess of the rated line voltage, e.g. 150 V or so for a 120 V line voltage. (This is because the specified line voltage is an RMS value of the sine waveform, not a peak-to-peak value.) If there were no load current drawn, then $V_{FWR}$ would stay at the maximum voltage of about 1.4 times the line voltage.

In the presently preferred embodiment, C1 is a 40 $\mu$F capacitor, but of course other values can be used. Capacitor C1 is preferably a continuous-duty power capacitor, with reasonably low series resistance. Capacitor C1 can optionally be omitted, but it does advantageously provide some protection for the regulator against voltage transients. It also provides better overall hum performance: ideally C1, under rated load, should be able to maintain a minimum voltage which is greater than the highest DC voltage to which the regulator output is desired to be controlled.

A conventional series regulator, with output capacitor C2, provides further smoothing of the current waveform. The regulator includes a power pass transistor, which switches (typically at a frequency of the order of 100 KHz) to provide a desired average current level.

The capacitor C2, in the presently preferred embodiment, is 300 $\mu$F. Note that this capacitor does not have to carry the high currents required of capacitor C1, so a normal electrolytic capacitor can be used. Capacitor C2 provides efficient suppression of the switching frequency, and also provides some further hum reduction.

FIG. 5 shows how a control voltage $V_{cont}$ is derived, in the presently preferred embodiment. An integrating resistor (e.g. 22 M$\Omega$) provides a long time constant (10s or 100s of msec) with capacitor C3; the resulting smoothed voltage is then divided down, by resistor $R_{ser}$ and variable resistor $R_{var}$, to provide a control voltage $V_{cont}$.

In the presently preferred embodiment, a small capacitor is provided after the full-wave rectifier. This capacitor provides some minimal smoothing of the current output of the full-wave rectifier. A series switching regulator circuit is provided downstream of this filter stage, and regulates the voltage applied to the resistive element in the blanket.

A variety of off-the-shelf switching regulators can be used, as long as the regulator can withstand the peak current (about 1 A or less) and power-line voltages. The regulator preferably uses a relatively low switching frequency (e.g. 30 KHz) to reduce power dissipation, though of course higher frequencies can optionally be used. The total power dissipation in the controller is preferably held to 10 W, though of course this power budget can be increased slightly with appropriate use of cooling fins. (Alternatively, the power budget can be increased substantially with use of an internal cooling fan, but this is not preferred.)

Temperature Sensing and Thermostat Control

As is common with electric blankets, a control relation is used so that the user sets a desired temperature rather than a desired heat output. This is implemented using a thermistor $R_{sense}$. However, the choice of control relationship is indifferent to the present invention, and this or other conventional relationships can be used.

Blanket Wiring Configuration

In the presently preferred embodiment, the electric blanket uses not only current regulation and hum reduction, but also uses a field-cancelling conductor layout.

Figure 1B:
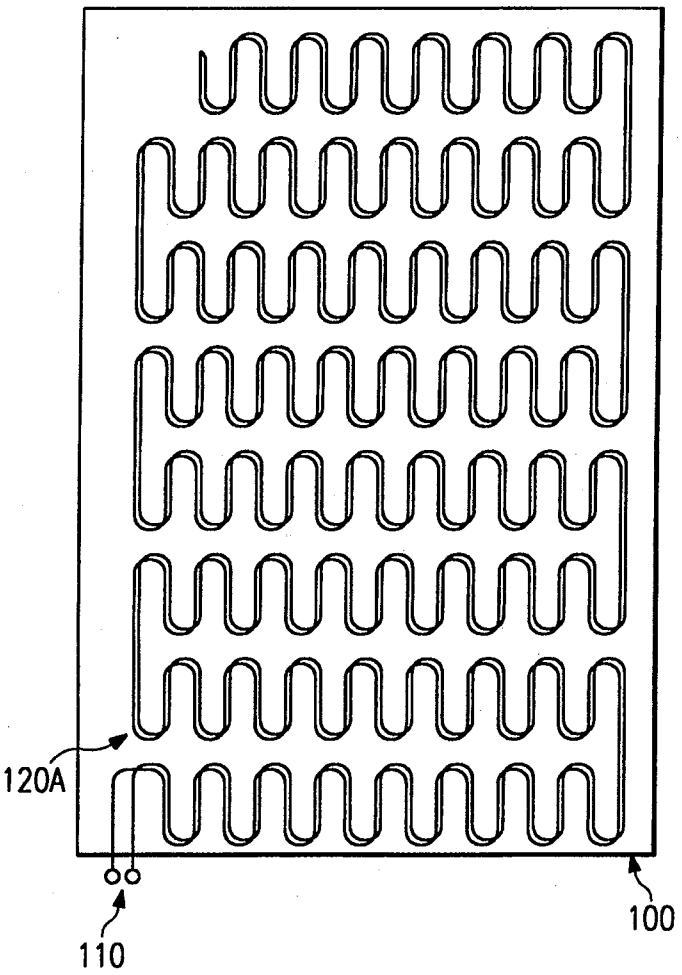
Figures 1B and 1C shows examples of wiring layouts in embodiments of the innovative electric blanket system disclosed herein.
Figure 1A:
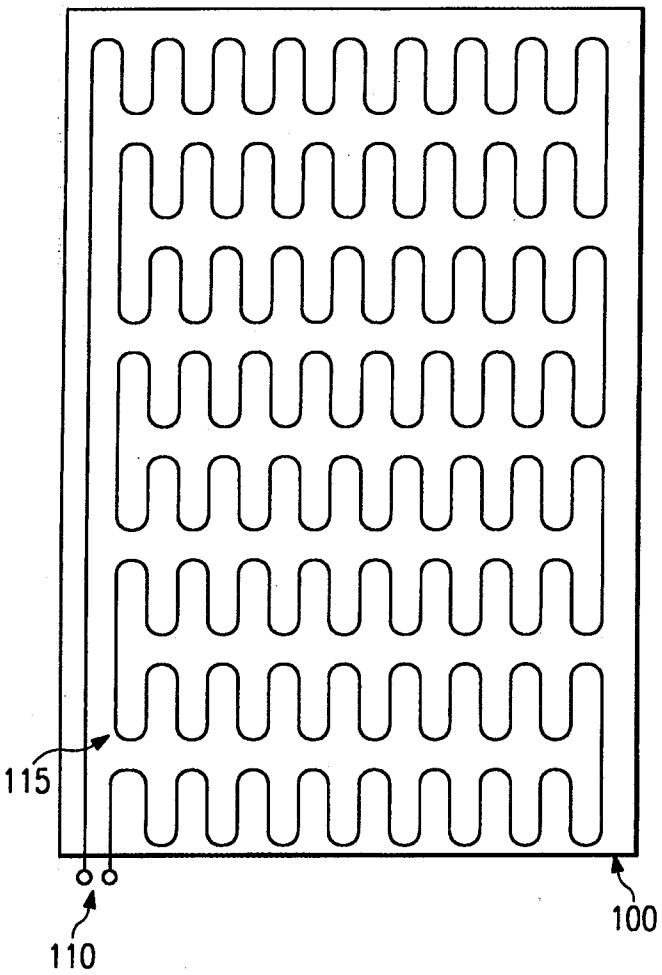
FIG. 1A (PRIOR ART)
FIG. 1A shows a typical layout for wiring in a resistive blanket of the prior art.
Figure 1C:
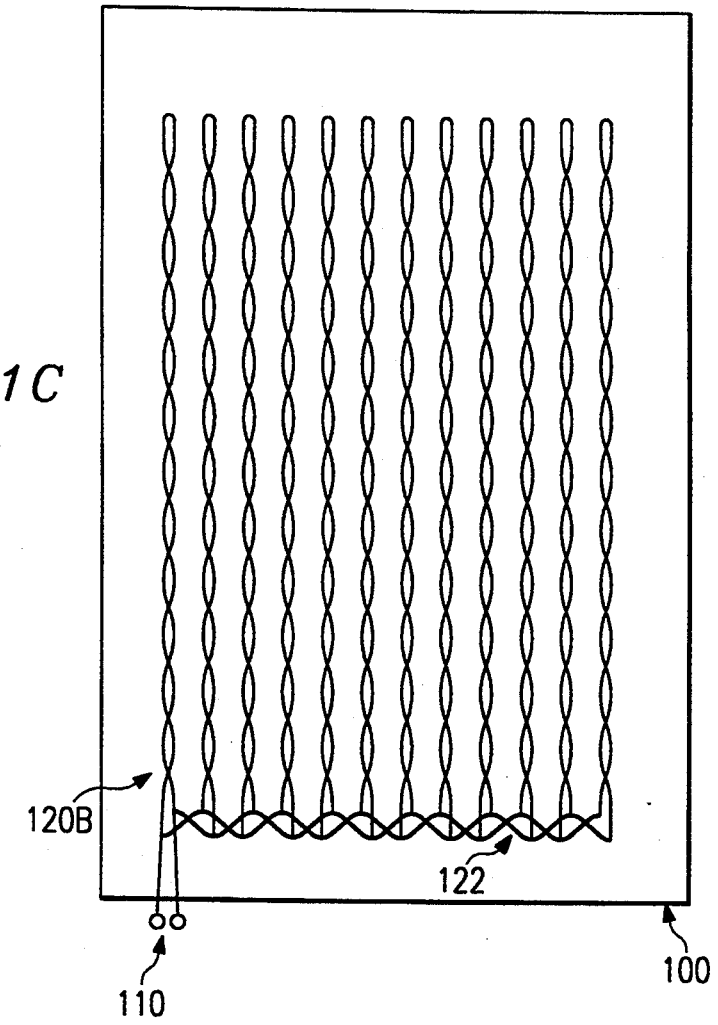

FIGS. 1A–1C show examples of resistive wiring layout within a blanket 100. In each of these, the resistive wires and thermal sensing connection are brought out to a connector 110. (For clarity, these Figures do not show the connections for thermistor elements, nor the thermal fusing which is necessary for safety.) FIG. 1A is an example of a blanket wiring layout, in which the wiring path is the same as a standard old-fashioned blanket. In the prior art example shown, the resistive wire 115 would be implemented simply as a single resistive wire, so no magnetic field cancellation is achieved. If such a layout is used with the innovative system, a field-cancelling wire layout, with bidirectional current flow in each portion of the wire, is used to reduce the low-frequency magnetic field radiation.

FIGS. 1B and 1C shows examples of wiring layouts which inherently provide some field cancellation without using special wire. FIG. 1B shows use of a pair of wires 120A, joined at the end opposite the connector 110, to provide bidirectional current flow in the heating wire length. FIG. 1C shows a different embodiment, in which high-impedance twisted pair wiring 120B is used in multiple branches, with a heavier-gauge twisted-pair 122 providing current supply to each branch.

FIGS. 3A–3D show other field-cancelling wiring configurations which can be used (and of course others can be used instead).

Figure 3A:
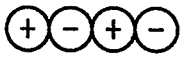

FIG. 3A shows a configuration wherein sets of four wires, two carrying currents of one sign and two carrying currents of the opposite sign, are located side by side in a "quadrupole" configuration. This configuration is part of the presently preferred embodiment.

Figure 3B:
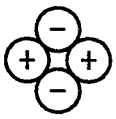

FIG. 3B shows another configuration, wherein sets of an even number of wires, half carrying currents of one sign and half carrying currents of the opposite sign, are bundled together to achieve approximately equal field cancellation from every angle.

Figure 3C:
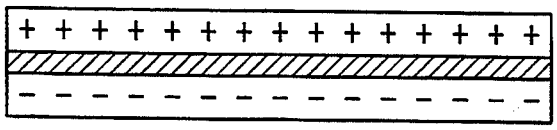

FIG. 3C shows yet another configuration, wherein two ribbon conductors, one carrying current of one sign and the other carrying current of the opposite sign, are overlaid on top of each other within the thickness of the blanket.

Figure 3D:
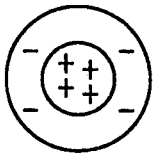

FIG. 3D shows yet another configuration, wherein coaxial wiring is used to achieve nearly perfect field cancellation. (In this embodiment, the inner element provides current flow which is complementary to the current flow in the outer conductor; but preferably only the outer conductor is made of resistance wire, since the electrical insulation between the inner and outer conductors tends to provide some thermal insulation also.)

Additional Elements

Of course, as will be obvious to those of ordinary skill in the art of designing electrical appliances for home use, additional features may be added for durability, safety, and/or regulatory compliance. For example, ground-fault-interruption circuitry can optionally be added, although the cost of this is significant. For another example, an internal fuse may be added. For another example, a varistor may be added, to protect the regulator and capacitors against voltage spikes in the power line. For another example, low-temperature thermal disconnects are typically embedded in the blanket itself, to prevent any part of the blanket reaching a temperature which might burn an unconscious user. For another example, a ground connection (from a 3-prong plug) may be routed into the blanket itself, to provide additional protection from possible breakage of insulation.

Further Modifications and Variations

It will be recognized by those skilled in the art that the innovative concepts disclosed in the present application can be applied in a wide variety of contexts. Moreover, the preferred implementation can be modified in a tremendous variety of ways. Accordingly, it should be understood that the modifications and variations suggested below and above are merely illustrative. These examples may help to show some of the scope of the inventive concepts, but these examples do not nearly exhaust the full scope of variations in the disclosed novel concepts.

In the embodiment illustrated, the final filter stage of the controller is provided by a single shunt capacitor of 300 $\mu$F. However, as will be readily recognized by those of ordinary skill in the art, other passive networks can be used instead.

For example, other field-cancelling wiring conformations can be used if desired.

For example, a wide variety of other low-hum DC power supply architectures can be substituted if desired.

Alternatively, for maximal hum reduction, a series pass transistor can be operated in analog mode. This increases power dissipation in the controller (and therefore is not preferred), but does permit further reduction in hum without the use of large passive components.

Alternatively, multiple active regulator stages can be used in series if desired, with passive filter stages interposed between them.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. An electric blanket system, comprising:

a plug for connection to an AC power line voltage;

a control module, comprising a diode ring connected to receive current from said power line and generate a full-wave rectified current therefrom;

a regulator, connected to regulate the output of said diode ring to a desired DC voltage level, and at least one associated capacitor, connected to filter the output of said regulator; said regulator and associated capacitor being configured to provide an output in which the DC current component has more than 20 times the magnitude of all AC current components under 1000 Hz;

a control circuit, connected to provide a control voltage to said regulator which is at least partially dependent on a user-selected control setting;

a blanket, incorporating a long resistive element embedded in said blanket, said long resistive element including a plurality of sections which are electrically connected in parallel, each said section being configured so that portions of said section which carry current in folded in a double configuration so that each portion of said section is closely adjacent to another portion thereof carrying current in an opposite sense; and a connector for mating to said control module; wherein said control module does not include a power transformer, and wherein current to said blanket is not passed through any iron-core inductor.

2. The system of claim 1, wherein said resistive element has a resistance of about $100\frac{5}{8}$.

3. The system of claim 1, wherein said resistive element includes at least four wires connected in a quadrupole configuration.

4. The system of claim 1, wherein said resistive element is made of coaxial cable.

5. The system of claim 1, wherein said regulator provides a controllable DC output voltage which is always less than 0.7 times the RMS AC voltage of the power line.

6. The system of claim 1, wherein said associated capacitor has a value greater than 100 $\mu$F.

7. The system of claim 1, wherein said blanket further comprises at least one temperature-sensing element.

8. An electric blanket system, comprising:

a connection for receiving a standard power line voltage;

a control module, comprising a rectification circuit connected to receive current from said power line and generate a full-wave rectified current therefrom;

a first capacitor, connected to filter the output of said full-wave rectifier;

a regulator, connected to regulate the output of said rectification circuit to a desired DC voltage level, and at least one associated capacitor, connected to filter the output of said regulator; said regulator and associated capacitor being configured to provide an output in which the DC current component has more than 10 times the magnitude of all AC current components under 1000 Hz;

a control circuit, connected to provide a control voltage to said regulator which is a least partially dependent on a user-selected control setting;

a blanket, incorporating a long resistive element embedded in said blanket, said long resistive element including a plurality of sections which are electrically connected in parallel, each said section being configured so that portions of said section which carry current in opposite senses lie closely adjacent to each other, to cancel magnetic fields therefrom; and a connector for mating to said control module and providing electrical connection therefrom to said resistive element.

9. The system of claim 8, wherein said resistive element has a resistance of about 100Ω.

10. The system of claim 8, wherein said resistive element includes at least four wires connected in a quadrupole configuration.

11. The system of claim 8, wherein said resistive element is made of coaxial cable.

12. The system of claim 8, wherein said regulator provides a controllable DC output voltage which is always less than 0.7 times the RMS AC voltage of the power line.

13. The system of claim 8, wherein said associated capacitor has a value greater than 100 $\mu$F.

14. The system of claim 8, wherein said first capacitor has a value greater than 10 $\mu$F.

15. The system of claim 8, wherein said blanket further comprises at least one temperature-sensing element.

* * * * *